US011147352B2

(12) United States Patent
Guglielmo

(10) Patent No.: US 11,147,352 B2
(45) Date of Patent: Oct. 19, 2021

(54) HAIR DRYER ATTACHMENT

(71) Applicant: Valerie R. Guglielmo, Chester, CT (US)

(72) Inventor: Valerie R. Guglielmo, Chester, CT (US)

( * ) Notice: Subject to any disclaimer, the term of this patent is extended or adjusted under 35 U.S.C. 154(b) by 48 days.

(21) Appl. No.: 16/829,206

(22) Filed: Mar. 25, 2020

(65) Prior Publication Data

US 2020/0315312 A1 Oct. 8, 2020

Related U.S. Application Data

(60) Provisional application No. 62/830,675, filed on Apr. 8, 2019.

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12; A45D 20/10; A45D 20/18; F04D 29/668
USPC ..... 34/95–100; D28/3, 18
See application file for complete search history.

(56) References Cited

U.S. PATENT DOCUMENTS 610,072 A * 8/1898 Mink ..... A24B 1/02 432/221
3,943,329 A * 3/1976 Hlavac ..... A45D 20/122 392/379
4,230,279 A * 10/1980 Forsberg ..... A45D 20/122 239/559
5,701,681 A * 12/1997 Wonka ..... A45D 20/12 34/96
5,761,824 A * 6/1998 Moon ..... A45D 20/12 34/97
5,987,771 A * 11/1999 Curtin ..... A45D 34/00 34/97
7,204,038 B2 * 4/2007 Santhouse ..... A45D 20/12 132/116
8,407,913 B2 * 4/2013 Langley ..... A45D 19/16 34/95
D711,043 S * 8/2014 Cooper ..... D28/38
8,800,163 B2 * 8/2014 Schmid ..... A45D 19/02 34/287

(Continued)

FOREIGN PATENT DOCUMENTS

GB 2540203 B * 7/2018 ..... A45D 20/122
JP 6538010 B2 * 7/2019 ..... A45D 20/122

*Primary Examiner* — Stephen M Gravini
(74) *Attorney, Agent, or Firm* — John F. Vodopia

(57) ABSTRACT

A hair dryer attachment is formed of a hollow cylinder made of high-heat resistant material and includes a first end and a second end, opposite the first end. The hollow cylinder extends an axial distance between the first end and the second end. The first end embodies a first opening that is larger in diameter than a second opening embodied by the second end. Vertical ribs extend inwardly from an internal surface of the hollow cylinder that are equally spaced along the internal surface of the cylinder. A plurality of hole patterns consisting of between five and fifteen holes that are centered along the interior between each of the vertical ribs. The first opening at the first end of the attachment is configured to be securely fixed over a barrel or air source of a hair dryer. The first end preferably comprises silicone rubber to facilitate a friction fit.

12 Claims, 4 Drawing Sheets

(56) References Cited

U.S. PATENT DOCUMENTS

| | | | | |
|---|---|---|---|---|
| 9,936,788 | B2 * | 4/2018 | Stephens | A45D 20/122 |
| 9,936,789 | B2 * | 4/2018 | Stephens | A45D 20/122 |
| 10,076,172 | B2 * | 9/2018 | Stephens | A45D 20/122 |
| 10,143,285 | B2 * | 12/2018 | Stephens | A45D 20/122 |
| 10,165,844 | B2 * | 1/2019 | Stephens | A45D 20/122 |
| 10,238,199 | B2 * | 3/2019 | Stephens | A45D 20/122 |
| D896,439 | S * | 9/2020 | Guglielmo | D28/18 |
| 10,765,191 | B2 * | 9/2020 | Stephens | A45D 20/122 |
| 2017/0055668 | A1 * | 3/2017 | Chen | H05B 3/16 |
| 2020/0315312 | A1 * | 10/2020 | Guglielmo | A45D 20/12 |

* cited by examiner

HAIR DRYER ATTACHMENT

CROSS-REFERENCE TO RELATED APPLICATIONS

This application derives the benefit of the priority under 35 USC § 119(e) to U.S. Provisional Patent Application No. 62/830,675, filed Apr. 8, 2019, the content of which provisional application is incorporated herein by reference.

FIELD OF THE INVENTION

The present invention relates to a hair dryer attachment. More specifically, the present invention relates to a high-heat resistant nozzle attachment that functions as an adapter for handheld hair dryers.

BACKGROUND OF THE INVENTION

Nozzle type hair dryer attachments are known. There are several references related to nozzle attachments adapted for placement on the end of a conventional hair dryer. Representative prior art includes U.S. Pat. Nos. 3,943,329, 1,951,269 and U.S. Patent Application Publication Nos. 2016/0022004 and 2017/0006991. However, these known devices can be problematic for the user.

Problem 1: Original Equipment Hair Dryer Attachments can Lose their Ability to Stay Securely Fixed Over Time.

Nearly every hand-held hair dryer is packaged and sold with its own product-specific, plastic attachment(s), in particular, nozzle attachment(s). The intense heat of a hair dryer, however, causes plastic to expand and contract, which can affect the long-term stability of an attachment. Over time, the attachment can become functionally compromised due to repeated heat exposure. Specifically, the attachment loses its ability to remain securely fixed to the hair dryer during use.

Problem 2: Original Equipment Hair Dryer Manufacturers Rarely Sell Individual, Product-Specific Nozzle Attachments.

Once an original hair dryer nozzle attachment is lost, compromised or broken, there are few viable replacements, namely because original equipment hair dryer manufacturers rarely sell individual, product-specific attachments.

Problem 3: Non-Product Specific Attachments do not Universally Fit all Hair Dryers.

Nozzle type attachments that are sold separately (i.e. concentrators, diffusers, combs, brushes, styling picks, etc.), more often do not universally fit all hair dryers.

Problem 4: Generic Fixed-Size Attachments are Typically of Low-Quality and/or Poorly Constructed.

Generic fixed-size hair dryer nozzle attachments are typically of low-quality and/or poorly constructed, namely because they melt or breakdown from high-heat, or do not fit or remain securely fixed to the hair dryer during use.

Problem 5: Attachments Designed to Provide a "Universal" Fit do not Fit Most Hair Dryers.

Universally-sized attachments have inherent design flaws, namely because they do not reliably fit most hair dryers, or remain securely fixed to the hair dryer during use.

Problem 6: A Nozzle Attachment Made of Plastic Will Become Burning-Hot to the Touch During Use.

The intense heat of the hair dryer will cause its plastic nozzle attachment to become incredibly hot, and can cause thermal burns to the hand upon contact or during removal, or merely when handled.

Unlike plastic nozzle attachments of a fixed or universal size, the inventive hair dryer attachment is highly flexible and durable, which allows it to conform to the size and shape of almost any full-size hair dryer barrel and its nozzle attachment. The physical nature of silicone provides a grip-like quality that also keeps the invention securely fixed to the hair dryer barrel and its nozzle attachment during use. Unexpectedly the invention also acts as a heat buffer, allowing the user to more safely handle and remove hot hair dryer nozzle attachments.

The invention has at least eight (8) internal ribs that extend between ⅛ inch to ½ inch, and preferably, approximately ¼ inch, from an inner wall of the attachment towards the axial center. The hole pattern/venting configuration and placement in the inventive attachment is unique. The overall size or length of the inventive attachment, is such that it fits most any hair dryer, or other attachment, is between approximately 1½ inch to 4¼ inch, but preferably 2½ inch.

The purpose of the invention is to provide a hair dryer attachment made of high-heat resistant silicone, that is easier to handle and retains less heat in use than conventional hair dryer nozzle attachments.

Another purpose of the invention is to provide a hair dryer attachment that is soft and flexible.

Another purpose of the invention is to provide a hair dryer attachment that is highly durable.

Another purpose of the invention is to provide a hair dryer attachment that will adapt to and fit almost any hair dryer barrel, having a length along a central axis that is between approximately 1½ inch to 4½ inch, but preferably 2½ inches.

Another purpose of the invention is to provide a hair dryer attachment that will adapt to and fit almost any other hair dryer nozzle attachment, for example, as an extension thereof.

Another purpose of the invention is to provide a hair dryer attachment with a flexible interior ribbing that adapts to and "grips" almost any hair dryer barrel, having a length along a central axis that is between approximately 1½ inch to 4½ inch, but preferably 2½ inches.

Another purpose of the invention is to provide a hair dryer attachment that adapts to and "grips" almost any other hair dryer nozzle attachment.

Another purpose of the invention is to provide a hair dryer attachment that maintains its original shape, even with repeated use.

Another purpose of the invention is to provide a hair dryer attachment that will not melt or breakdown and will resist heat up to at least 450 degrees Fahrenheit.

Yet another purpose of the invention is to provide a hair dryer attachment that acts as a buffer and helps protect hands from hot nozzle attachments.

Another purpose of the invention is to provide a hair dryer attachment with added ventilation to allow for heat to be released more rapidly.

SUMMARY OF THE INVENTION

In the present invention, these purposes, as well as others which will be apparent, are achieved generally by a hair dryer attachment made of an open-ended hollow cylinder, made of high-heat resistant silicone rubber, where one opening is larger than the other; at least eight (8), not more than sixteen (16), and preferably ten (10) vertical ribs are equally spaced along the interior wall of said cylinder; extending towards the axial center, and a plurality of hole patterns, each consisting of between five (5) and fifteen (15), and preferably seven (7) openings, centered along the wall of said cylinder between each of said vertical ribs both with respect to the axial length and the distance between the ribs. For example, there are nine (9) hole patterns in an attachment embodiment comprising ten (10) ribs.

The inventive attachment, typically the end with the smaller diameter, is inserted into or placed over the air outlet of nozzle attachment, (i.e. concentrator, diffuser, comb, brush, styling pick, etc.). The other end of the inventive attachment, typically the end with the larger diameter, then receives the barrel or air source of the hair dryer and secures by friction fit, i.e., the inventive attachment slides over a portion of the outer surface of the barrel or air source of the hair dryer. Alternative, the barrel or air source of the hair dryer may be inserted within an inner volume of the inventive attachment, where the inner surface thereof contacts and secures by friction fit, the outer surface of the barrel of the hair dryer.

In an embodiment, the invention provides a hair dryer attachment formed of a hollow cylinder made of high-heat resistant material and includes a first end and a second end, opposite the first end. The hollow cylinder extends an axial distance between the first end and the second end. The first end embodies a first opening that is larger in diameter than a second opening embodied by the second end. Vertical ribs extend inwardly from an internal surface of the hollow cylinder that are equally spaced along the internal surface of the cylinder. A plurality of hole patterns consisting of between five and fifteen holes that are centered along the interior between each of the vertical ribs.

The first opening at the first end of the attachment is configured to be securely fixed over a barrel or air source of a hair dryer. The second opening at the second end of the attachment is configured to be inserted into or placed over the air outlet opening of another nozzle attachment, and securely fixed thereto. The first end preferably comprises silicone rubber to facilitate a friction fit. For that matter, the second end comprises silicone rubber to facilitate a friction fit.

Preferably, there are ten (10) vertical ribs. Preferably, the number of holes in the hole pattern is seven (7). The vertical ribs extend inwardly between 0.1 and 0.6 times the radius of the cylinder. Preferably, the vertical ribs extend inwardly between one-half inch and one inch. Most preferably, the vertical ribs taper as shown in FIGS. 2*b*, 2*d*, 2*e* and/or 3*b*. In one embodiment, the hole patterns are off-center. Preferably, the axial length is between two (2) and five (5) inches, and most preferably, the axial length is two and one-half inches.

Other objects, features and advantages of the present invention will be apparent when the detailed description of the preferred embodiments of the invention are considered with reference to the drawings, which should be construed in an illustrative and not a limiting sense.

DETAILED DESCRIPTION OF THE INVENTION

Figure 1:
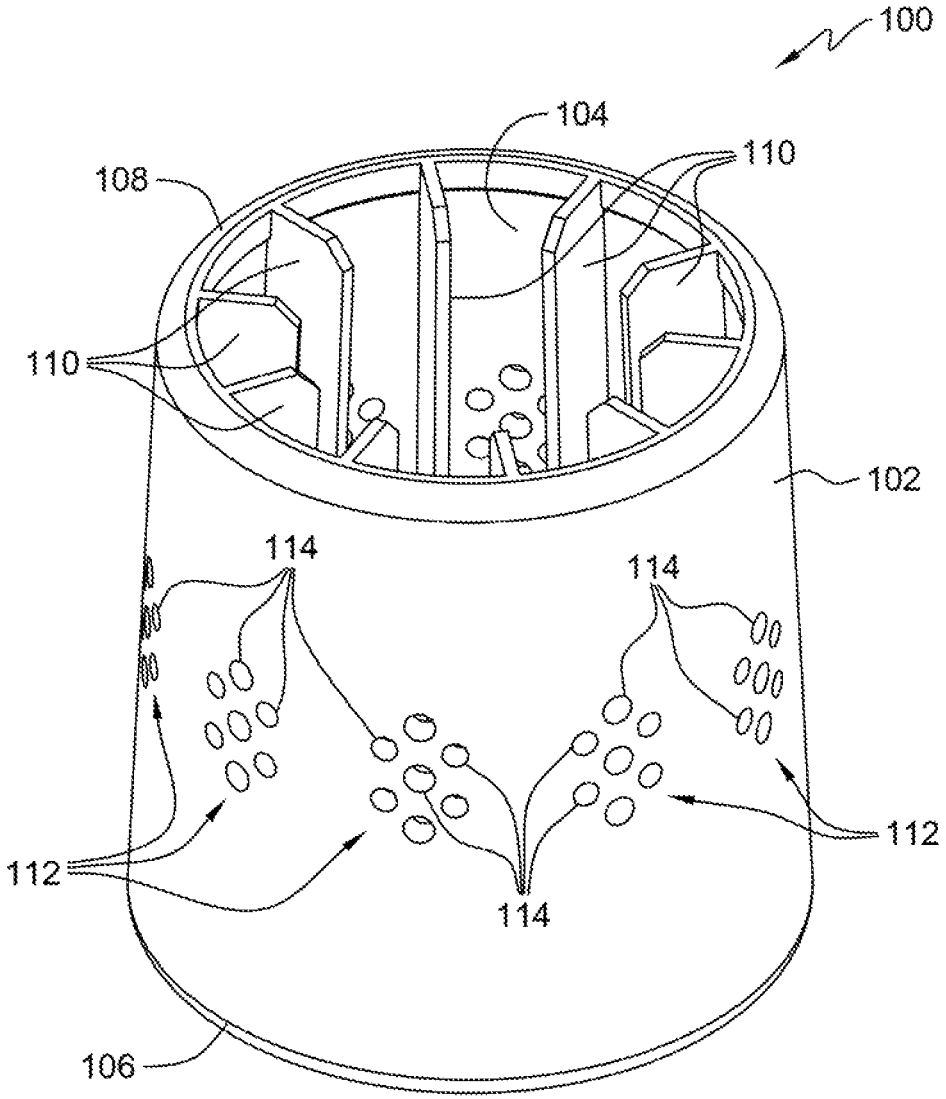
FIG. 1 is a front, top perspective view of one embodiment of the inventive attachment.
Figure 2A:
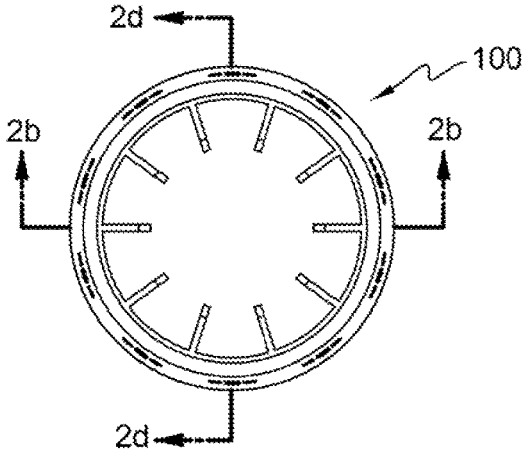
FIG. 2*a* is a top plan view of the inventive attachment of FIG. 1.
Figure 2B:
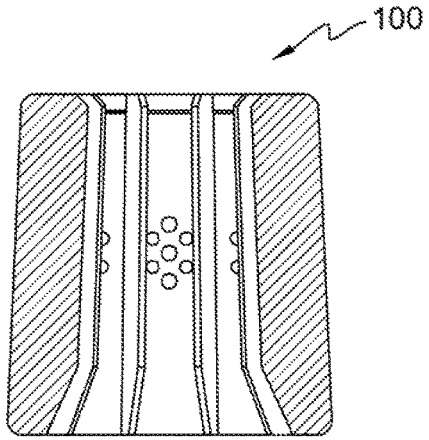
FIG. 2*b* is a cross-sectional view of the inventive attachment of FIG. 2*a*, taken along the line 2*b*-2*b*, thereof.
Figure 2C:
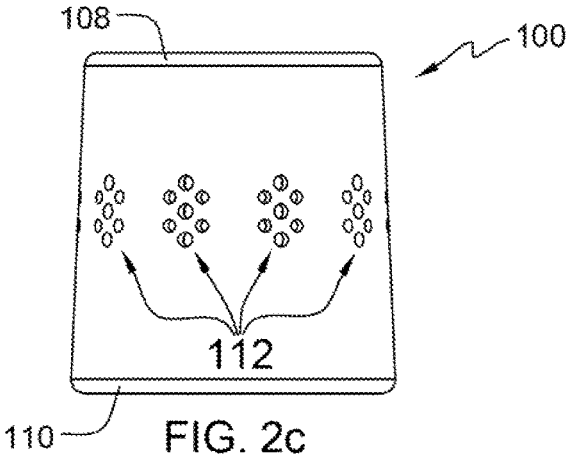
FIG. 2*c* is a side view of inventive attachment of FIG. 1 (and FIG. 2*b*), highlighting a hole pattern.
Figure 2D:
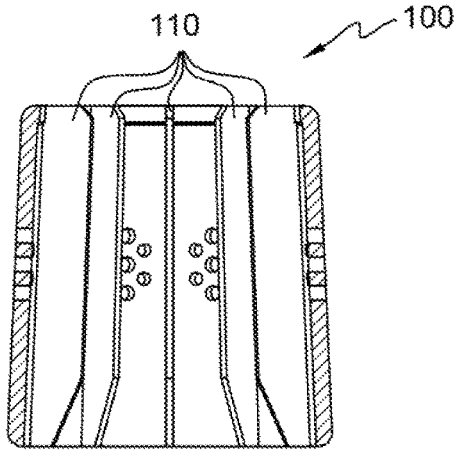
FIG. 2*d* is a cross-sectional view of the inventive attachment of FIG. 2*a*, taken along the line 2*d*-2*d*, thereof.
Figure 2E:
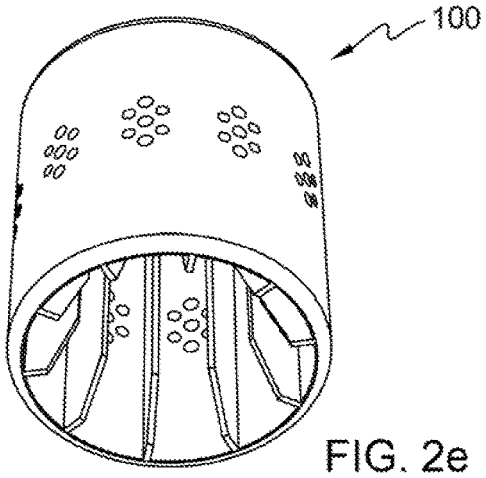
FIG. 2*e* is a rear, bottom perspective view of the inventive attachment of FIG. 1.
Figure 2F:
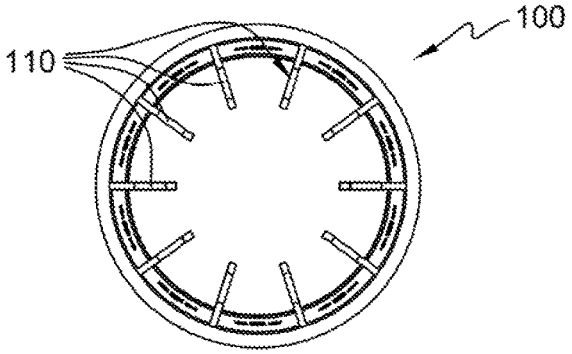
FIG. 2*f* is a bottom plan view of the inventive attachment of FIG. 1.
Figure 3A:
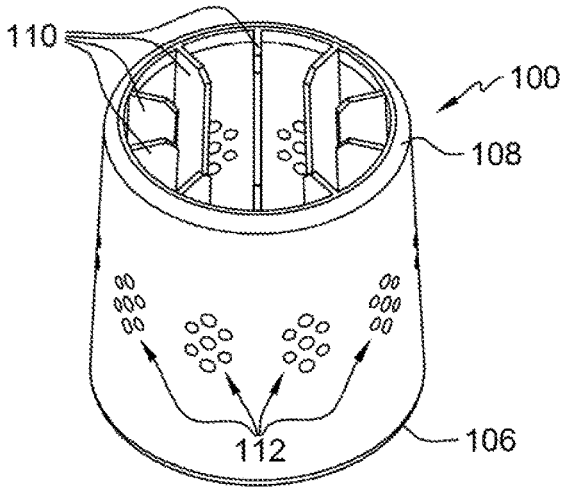
FIG. 3*a* is a top, front perspective view of the inventive attachment.
Figure 3B:
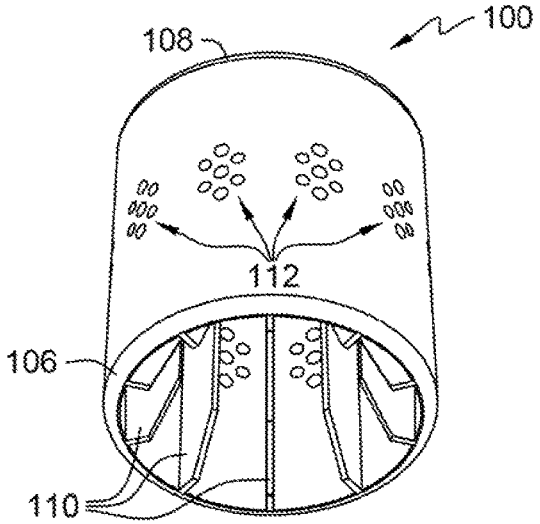
FIG. 3*b* is a bottom, rear perspective view of the inventive attachment of FIG. 3*a;*
Figure 3C:
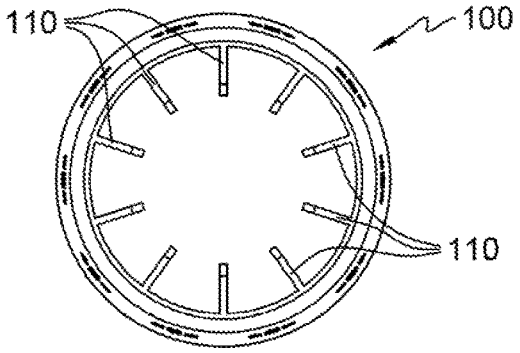
FIG. 3*c* is a top plan view of the inventive attachment of FIG. 3*a;*
Figure 3D:
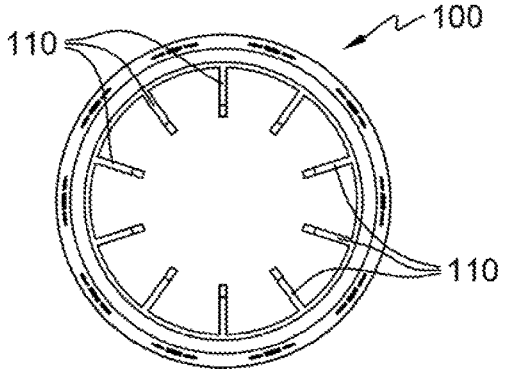
FIG. 3*d* is a bottom plan view of the inventive attachment of FIG. 3*a;*
Figure 3E:
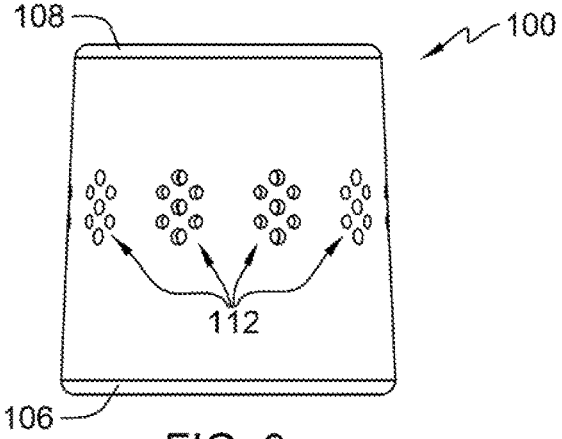
FIG. 3*e* is a left side, plan view of the inventive attachment of FIG. 1.
Figure 3F:
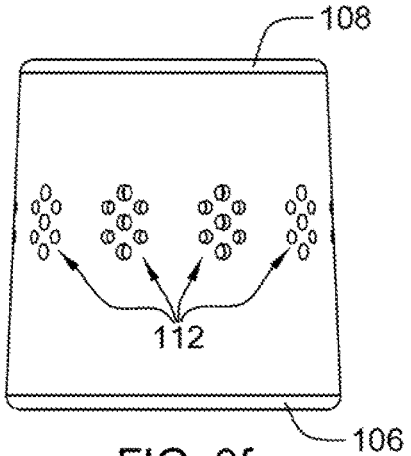
FIG. 3*f* is a right bottom plan view of the inventive attachment of FIG. 1.
Figure 4A:
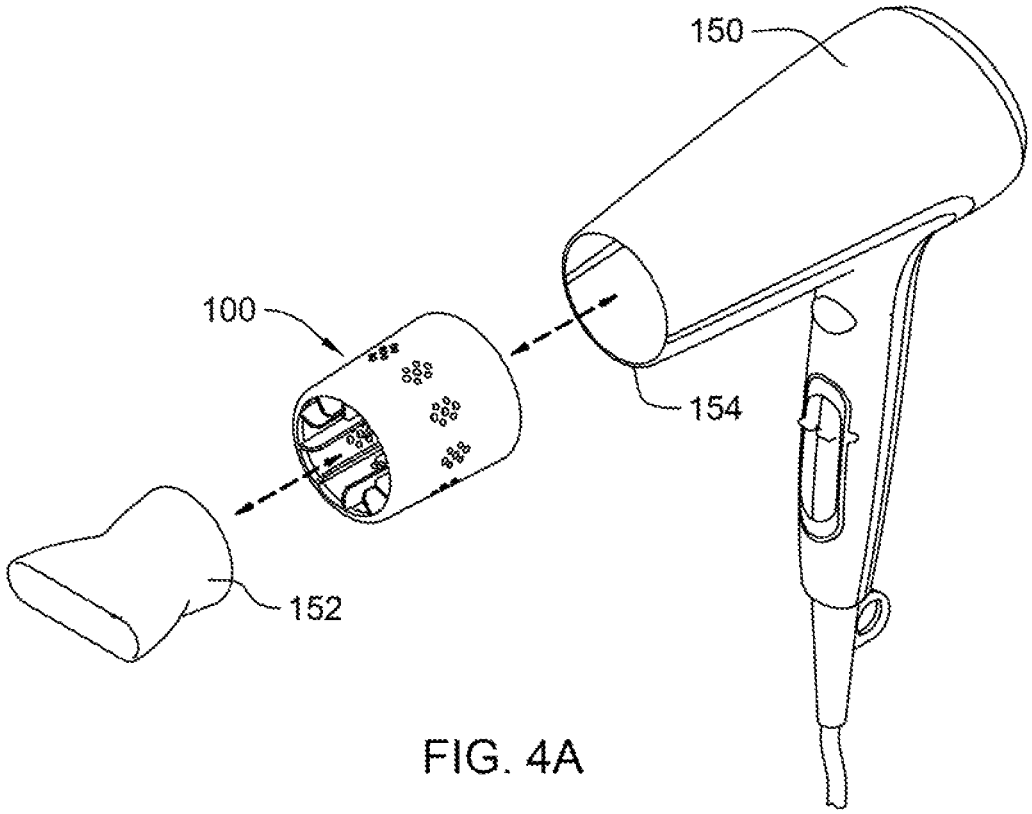
FIG. 4A is an illustration of the inventive attachment in an exploded view depicting a hair dryer, the inventive attachment and a conventional nozzle, from right to left, as shown.
Figure 4B:
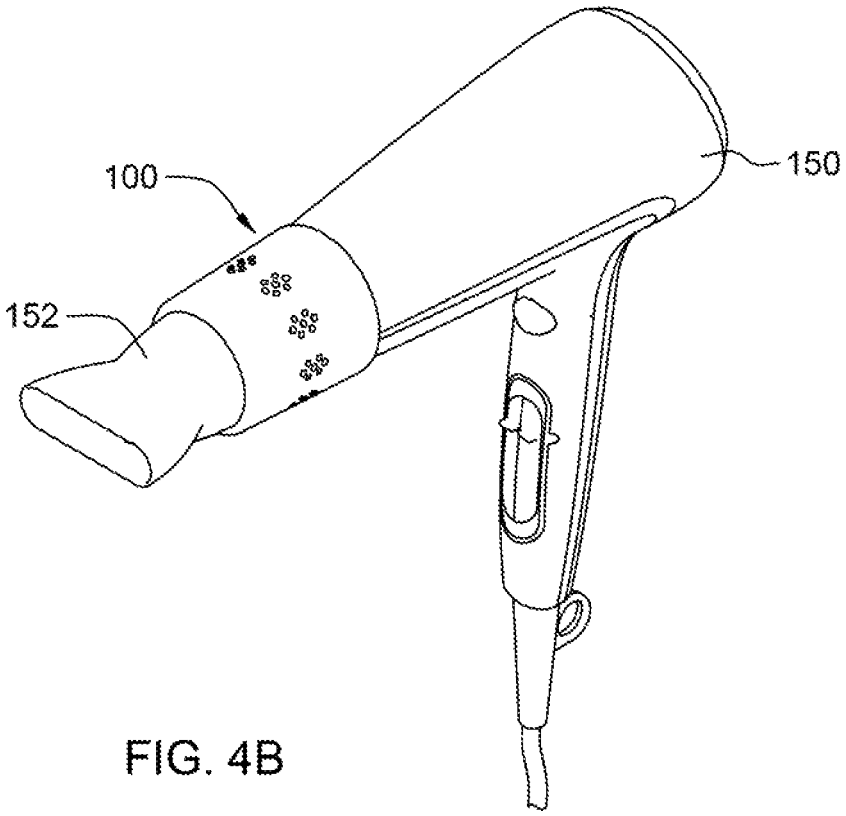
FIG. 4B depicts the hair dryer with the inventive attachment provided thereon, and the nozzle fixed to the attachment.

As illustrated in FIGS. 1, 2*a-f*, 3*a-f*, 4A and 4B, the inventive attachment 100 is a substantially hollow cylinder-like structure formed with an outer surface 102 and an inner surface 104, and defined by an axial length, extending between an end 106 for attachment to the hair dryer (not shown in FIG. 1) and an opposing end 108, from which air is exhausted during intended hair dryer operation when the attachment is affixed thereto by friction fit. The axial length may be any length in a range of approximately 2 inches to 4½ inches, for example, 2½ inches. The radius of the cylinder-like structure is between 0.6 inches and 2 inches, for example one (1) inch. Preferably, the attachment 100 is made of plastic, high-heat silicone rubber, or similar substance as long as the substance from which the attachment is formed is heat resistant up to at least 450 degrees Fahrenheit.

The inventive attachment 100 is open on both ends 106, 108, where one opening (e.g., at end 106) is larger in diameter than the opposite opening (e.g., at end 108). Preferably the larger opening at end 106 attaches to the barrel or air source of the hair dryer (154, see FIGS. 4A and 4B).

The inventive attachment 100 is placed over the barrel or air source of the hair dryer 154 and securely fixed (preferably by friction fit). The other end 108 of the inventive attachment is then inserted into or placed over the air outlet of another attachment (152, see FIGS. 4A and 4B) and securely fixed. In this manner, the inventive attachment 100 performs an adapter function, thus is enables a user to secure another attachment 152 to the barrel or air source of the hair dryer 154, via the inventive attachment (see FIGS. 4A and 4B). As such, the inventive attachment allows for concentrators, diffusers, comb nozzles, styling picks, etc., without limitation. Alternatively, the other open end 108 of attachment 100 is left open (unattached), from which air is exhausted during intended operation.

At least one end (preferably end 106 comprising the larger opening) is formed of silicone rubber or like material, so that there is substantially more friction than there would be than if end 106 was formed with plastic, or other non-rubber-like material. As such, there is a lesser likelihood that the attachment would slip off the barrel or air source to which it is attached. Most preferably, both ends 106 and 108 are formed of silicone, rubber or like materials to fixedly secure each end (as the case may be) by friction fit.

There are between eight (8) and sixteen (16) and preferably ten (10) vertical ribs 110, equally spaced along the interior cylinder wall 104 of the inventive attachment 100. These ribs 110 help to increase air flow between the wall of the attachment and the exterior barrel 154 of the hair dryer, thereby reducing thermal heat transfer. The ribs 110 also provide added flexibility so that the inventive attachment can more easily conform/adapt to the shape and size of the hair dryer nozzle 152 and other attachments. When fewer than eight (8) ribs 110 are used, the invention attachment may become hot, for example, making it uncomfortable or difficult to handle.

In addition to the internal ribs 110, there are a number of hole patterns 112, each consisting of between five (5) and fifteen (15), and preferably seven (7) openings 114. The hole patterns 112 are preferably centered along the wall of the cylinder between each of said vertical ribs 110 both with respect to the axial length and the distance between the ribs. For example, there are nine (9) hole patterns in an attachment embodiment comprising ten (10) ribs. These hole patterns 112 allow for heat to be released from the attachment 100 and more rapid cooling (see FIGS. 1, 2*b*, 2*c*, 3*a*, 3*b* and 3*e*, for example).

The properties of high-heat silicone material are ideal for the use of the inventive attachment 100. As so formed, the inventive attachment is resistant to heat buildup, retains its original shape with repeated use and exhibits flexibility. The attachment's flexibility so formed allows it to conform to a variety of hair dryer barrels 154 and other nozzle attachments 152 (See FIGS. 4A and 4B).

Possible variations include using thermoplastic elastomer (TPE) in place of silicone, as long as the material from which the inventive attachments are formed are heat resistant up to at least 450 degrees Fahrenheit.

The foregoing description of various and preferred embodiments of the present invention has been provided for purposes of illustration only, and it is understood that numerous modifications, variations and alterations may be made without departing from the scope and spirit of the invention as set forth in the following claims.

The invention claimed is:

1. A hair dryer attachment, comprising:

a hollow cylinder made of high-heat resistant material that includes a first end and a second end, the second end opposite the first end, wherein the hollow cylinder extends an axial distance between the first end and the second end, wherein the first end embodies a first opening that is larger in diameter than a second opening embodied by the second end, wherein at least eight (8) vertical ribs extend inwardly from an internal surface of the hollow cylinder, the vertical ribs being equally spaced along the internal surface of the cylinder, wherein a plurality of hole patterns consisting of between five (5) and fifteen (15) holes that are centered along the interior between each of the vertical ribs, and wherein the first opening at the first end of the attachment is configured to be securely fixed over a barrel or air source of a hair dryer 154.

2. The hair dryer attachment of claim 1, wherein the second opening at the second end of the attachment is configured to be inserted into or placed over the air outlet opening of another nozzle attachment, and securely fixed thereto.

3. The hair dryer attachment of claim 1, wherein the first end comprises silicone rubber to facilitate a friction fit.

4. The hair dryer attachment of claim 1, wherein the second end comprises silicone rubber to facilitate a friction fit.

5. The hair dryer attachment of claim 1, wherein there are ten (10) vertical ribs.

6. That hair dryer attachment of claim 1, wherein a number of holes in the hole pattern is seven (7).

7. The hair dryer attachment of claim 1, wherein the vertical ribs extend inwardly between 0.1 and 0.6 times a radius of the cylinder.

8. The hair dryer attachment of claim 1, wherein the vertical ribs extend inwardly between one-half inch and one inch.

9. The hair dryer attachment of claim 1 wherein the vertical ribs taper.

10. The hair dryer attachment of claim 1, wherein the hole patterns are off-center.

11. The hair dryer attachment of claim 1, wherein an axial length is between two (2) and five (5) inches.

12. The hair dryer attachment of claim 1 1, wherein the axial length is two and one-half inches.

* * * * *